US010029847B2

(12) United States Patent
Funkquist et al.

(10) Patent No.: US 10,029,847 B2
(45) Date of Patent: Jul. 24, 2018

(54) DISTRIBUTION OF TETRAHEDRAL PACKAGES

(71) Applicant: TETRA LAVAL HOLDINGS & FINANCE S.A., Pully (SE)

(72) Inventors: Ola Funkquist, Lund (SE); Karin Teghammar, Malmo (SE)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 169 days.

(21) Appl. No.: 14/786,904

(22) PCT Filed: Apr. 10, 2014

(86) PCT No.: PCT/EP2014/057317
§ 371 (c)(1),
(2) Date: Oct. 23, 2015

(87) PCT Pub. No.: WO2014/173696
PCT Pub. Date: Oct. 30, 2014

(65) Prior Publication Data

US 2016/0090232 A1 Mar. 31, 2016

(30) Foreign Application Priority Data

Apr. 23, 2013 (SE) ..... 1350503

(51) Int. Cl.
*B65D 85/00* (2006.01)
*B65D 71/50* (2006.01)
*B65D 71/40* (2006.01)

(52) U.S. Cl.
CPC ..... *B65D 85/542* (2013.01); *B65D 71/40* (2013.01); *B65D 71/50* (2013.01)

(58) Field of Classification Search
CPC ..... B65D 85/542; B65D 71/40; B65D 71/50
(Continued)

(56) References Cited

U.S. PATENT DOCUMENTS 3,244,274 A * 4/1966 Wasyluka ..... B65D 85/542 206/436
3,250,386 A 5/1966 Boynton
(Continued)

FOREIGN PATENT DOCUMENTS

JP S50-65381 A 6/1975
JP H09-118368 A 5/1997
(Continued)

OTHER PUBLICATIONS

International Preliminary Report on Patentability and Written Opinion of the International Searching Authority (Forms PCT/IB373 and PCT/ISA/237) dated Nov. 5, 2015, by the International Bureau of WIPO, in corresponding International Application No. PCT/EP2014/057317. (8 pages).
(Continued)

*Primary Examiner* — Andrew Perreault
(74) *Attorney, Agent, or Firm* — Buchanan Ingersoll & Rooney PC

(57) ABSTRACT

A method of assembling irregular tetrahedral packages having a first orientation and a mirrored second orientation, the packages each having two panels that are isosceles right triangles, and two elongated panels that are right triangles. The method involves providing an L-shaped blank having a rectangular central wall, rectangular right and left walls attached on neighboring edges of the central wall via weakening lines, arranging one package with a first orientation and one package with a second orientation on each of the right wall, left wall and central wall, wherein all packages are placed such that a panel with isosceles right triangle shape faces the cardboard blank, and where the hypotenuse of the panel is directed towards a central corner, between the right wall and the left wall, and such that the top downward
(Continued)

angled edges of all packages also are directed towards the central corner.

3 Claims, 6 Drawing Sheets

(58) Field of Classification Search
USPC ..... 206/436; 493/379
See application file for complete search history.

(56) References Cited

U.S. PATENT DOCUMENTS 3,261,461 A * 7/1966 Fontana ..... B65D 85/542 206/436
3,261,462 A 7/1966 Perry
3,347,363 A 10/1967 Dykes et al.
3,890,763 A 6/1975 Ullman
4,258,479 A 3/1981 Roane
5,915,869 A * 6/1999 Agosto ..... A47L 13/07 15/104.93
8,695,848 B2 * 4/2014 Cook ..... B65D 83/0847 206/436

FOREIGN PATENT DOCUMENTS

JP 3401247 B2 4/2003
SE 204 696 C 5/1966
SE 204696 5/1966
WO 93/01979 A1 2/1993

OTHER PUBLICATIONS

International Search Report (PCT/ISA/210) dated Jul. 31, 2014, by the European Patent Office as the International Searching Authority for International Application No. PCT/EP2014/057317.

* cited by examiner

DISTRIBUTION OF TETRAHEDRAL PACKAGES

FIELD OF THE INVENTION

The invention relates to distribution of tetrahedral packages, and in particular to how irregular tetrahedral packages should be grouped into assemblies to be distributed.

BACKGROUND OF THE INVENTION

Tetrahedral packages have been manufactured and distributed for many years, and Tetra Pak® has been developing such systems since 1950. The normal tetrahedral package has a drawback, however, in that it not easily allows packaging in a space-convenient way. Specific odd-shaped secondary boxes were developed for handling the shipping, but they were costly and are not easily adapted to be packaged in automatic lines.

In US patent application from 1964, U.S. Pat. No. 3,347,363, an irregular tetrahedral package was disclosed which enabled tight packing within a cube. The general idea is that a cube can be filled completely by using a combination of irregular tetrahedrons and tetrahedrons with a mirrored shape thereof. An internet search of space-filling tetrahedrons reveals different possible packing patterns.

However, the irregular tetrahedrons are not easy to assemble into a cube since neither the intermediate or the final assembly is stable in itself. There is hence a need for additional support. In U.S. Pat. No. 3,347,363, it is mentioned that tetrahedral should be joined at their interfaces with some form of adhesive. It is also stated that a package comprised of a plurality of containers can include a rectangular three-dimensional enclosure (a box) for maintaining the containers in assembled condition. However, no details are mentioned for either the application of the adhesives of the enclosure for holding the packages assembled, or in what pattern the adhesive should be applied.

The general shape of the irregular tetrahedron, and its mirrored version, that can be used to completely fill a cube has been known at least since the year 1900. In reply to a problem posed by David Hilbert (the third Hilbert problem), Hilbert's student Max Dehn presented the proof in form of a counter-problem, inter alia comprising an irregular tetrahedron that, with a mirror version, completely could fill a cube. Guy Inchbald shows on his website www.steelpillow-.com that you can use three irregular tetrahedrons and three mirrored versions for completely space filling a cube. This is also shown on the website www.korthalsaltes.com, which shows how four such tetrahedrons are assembled, lacking only a mirrored pair to complete the assembly. However, none of the latter mentions how six tetrahedrons can be held together in a box or similar assembly, in the tight cube packing pattern.

SUMMARY OF THE INVENTION

It is hence an object of the present invention to present suitable solutions for easy assembly of said cube of six irregular tetrahedrons.

In a first aspect, the invention provides a method of assembling a group of irregular tetrahedral packages (1*a*, 1*b*) having a first orientation and a mirrored second orientation, said packages (1*a*, 1*b*) each having two panels (5, 6) that are isosceles right triangles, and two elongated panels (7, 8) that are right triangles, comprising the steps of:

providing an L-shaped blank (10) having a rectangular central wall (15), a rectangular right wall (13), and a rectangular left wall (14), the right wall (13) and the left wall (14) being attached on neighbouring edges of the central wall (15) via weakening lines (11, 12), arranging one package (1*a*) with a first orientation and one package (1*b*) with a second orientation on each of the right wall (13), left wall (14) and central wall (15), wherein all packages (1*a*, 1*b*) are placed such that a panel (5, 6) with isosceles right triangle shape faces the cardboard blank (10), and where the hypotenuse of said panel is directed towards a central corner (16), between the right wall (13) and the left wall (14), and such that the top downward angled edges of all packages also are directed towards said central corner (16), such that the cardboard blank can be folded into a cube by angling the right wall (13) from an unfolded position, and by angling the left wall (14) from an unfolded position, until the packages (1*a*, 1*b*) rest on top of the packages (1*a*, 1*b*) on the central wall (15). The right wall (13) and the left wall (14) are typically folded 70-110 degrees from an unfolded, flat position, or approximately 90 degrees. The method can further comprise a step of attaching two packages (1*a*, 1*b*) together prior to being arranged on a wall (13, 14, 15), e.g. with an adhesive (52, 53) that is attached on a central line of an elongated panel (7; 8) of at least one package (1*a*; 1*b*).

In a yet further aspect, the invention provides an assembly of two irregular tetrahedral packages (1*a*, 1*b*) having a first orientation and a mirrored second orientation, said packages having two panels (5, 6) that are isosceles right triangles, and two elongated panels (7, 8) that are right triangles, wherein an elongated panel (7; 8) of one package (1*a*; 1*b*) is provided with an adhesive (52, 53), and a correspondingly shaped panel (8; 7) of the other package (1*b*; 1*a*) is pressed against said panel being provided with adhesive. In the assembly, it is further possible that the adhesive is provided along a central line (51) of said elongated panel (7; 8). The adhesive (52, 53) can further be provided in two separate groups along the central line (51) of said elongated panel (7; 8).

In a further aspect, the invention provides an assembly of six irregular tetrahedral packages (1*a*, 1*b*) having a first orientation (1*a*) and a mirrored second orientation (1*b*), said packages (1*a*, 1*b*) having two panels (5, 6) that are isosceles right triangles, and two elongated panels (7, 8) that are right triangles, wherein three pairs of two mirrored packages (1*a*, 1*b*) are placed inside a low tray (30), having a bottom wall matching the size of a cubic arrangement of said six packages. In the assembly, the three pairs of mirrored packages (1*a*, 1*b*) can be encircled by a looped ribbon (40), holding the six packages together. In the assembly, each pair of mirrored packages (1*a*, 1*b*) can be attached together using an adhesive (52, 53) on adjacent panels (7; 8).

In a further aspect, the invention provides an assembly of three irregular packages (1*a*, 1*b*) having a first orientation (1*a*) and a mirrored second orientation (1*b*), said packages (1*a*, 1*b*) having two panels (5, 6) that are isosceles right triangles, and two elongated panels (7, 8) that are right triangles, wherein two packages of a first orientation (1*a*; 1*b*) and one package of a second orientation (1*b*; 1*a*) can be placed together, forming a triangular prism (60). A group of four such prisms, standing on a triangular face thereof, can be placed together such that their right angled corners meet at a center, such that a half-cube is formed. A group of two such prisms (60), forming cubes, can be placed side-by-side, forming an elongated cuboid assembly.

All features described in connection with any aspect of the invention can be used with any other aspect of the invention.

BRIEF DESCRIPTION OF THE DRAWINGS

The invention will be further described with reference to a preferred embodiment, as shown in the drawings in which.

DETAILED DESCRIPTION

Figure 1:
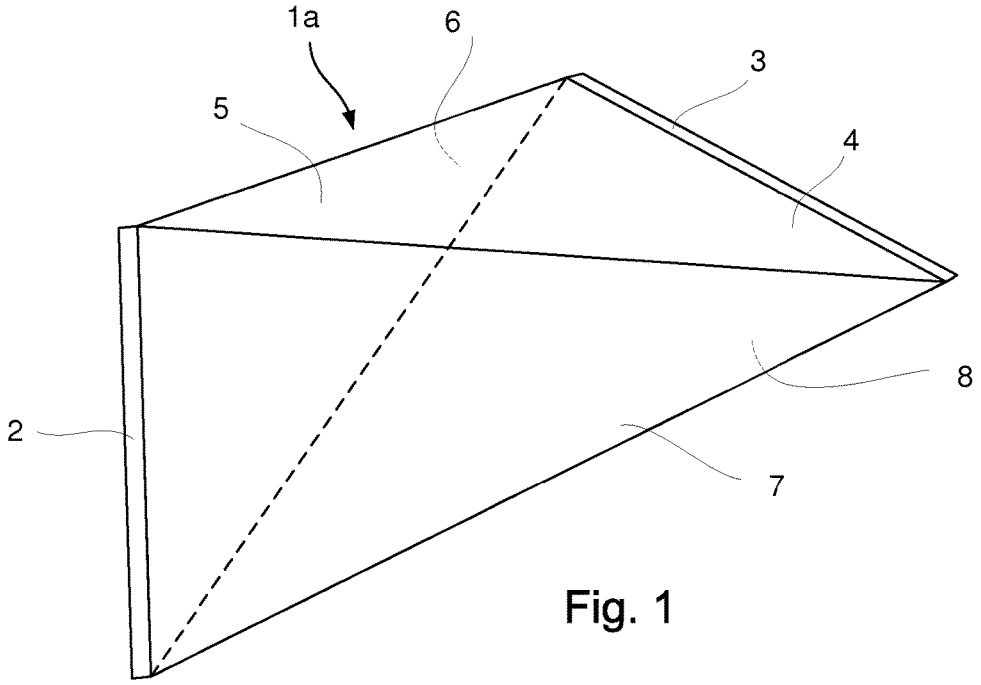
FIG. 1 shows a perspective view of an irregular tetrahedron that will be grouped into an assembly according to the invention.

The present invention relates to the distribution of irregular tetrahedral packages for e.g. liquid food. One such package 1*a* can be seen in FIG. 1, and a mirrored version 1*b* must also be used in order to completely fill a cube, see FIG. 2. The package 1*a*, 1*b* comprises two sealed fins 2, 3 and has a body 4 that can be filled with a product, such as powder, small articles or a liquid. If the packed product is a perishable liquid food, the package 1*a*, 1*b* is preferably of a known kind, comprising a carton core, an aluminium barrier foil layer (or similar) and outer coatings of polymeric material, such as low density polyethylene (LDPE). Such packaging material has been used for many years in the carton food industry, e.g. by Tetra Pak®.

The package 1*a* has four panels, two panels 5, 6 that are isosceles right triangles, and two elongated panels 7, 8 that are right triangles. The two isosceles panels 5, 6 share a leg, and the two elongated right triangles 7, 8 share a hypotenuse. The package 1*b* has the same shape of the panels 5, 6, 7, 8, but their orientation is mirrored.

Figure 2:
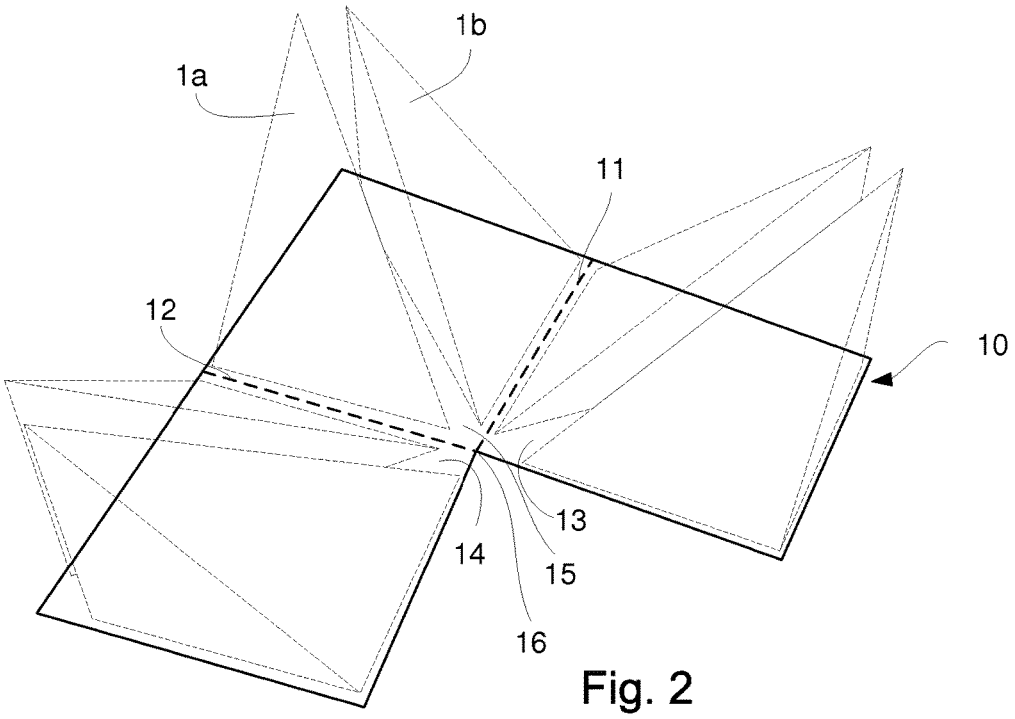
FIG. 2 shows a perspective view of six tetrahedrons, placed in pairs on a cardboard blank.

In FIG. 2, an L-shaped first blank 10 is shown made from carton or cardboard. Six irregular tetrahedral packages 1*a*, 1*b*, three of one orientation and three mirrored versions, are indicated with dashed lines as they are placed on the blank 10. The packages 1*a*, 1*b* may be attached to the blank 10 with the use of some adhesive, such as hot-melt glue or double-sided tape. The first blank 10 is provided with two folding lines 11, 12, such that a right wall 13 and a left wall 14 can be folded towards a central wall 15. This will bring the packages 1*a*, 1*b* on the right wall 13 and left wall 14 on top of the packages 1*a*, 1*b* on the central wall 15, and a cube will be formed. Normally, the walls are angled approximately 90 degrees, or between 70-110 degrees. In order to keep the right wall 13 and left wall 13 in place, adhesive can be used between adjacent packages, i.e. a package on the right wall 13 is attached to a package on the central wall 15, and a package on the left wall 14 is attached to a package on the central wall 15.

When the packages 1*a*, 1*b* are placed on the cardboard blank, they should have a panel 5, 6 with isosceles triangle shape facing the first cardboard blank 10, and the hypotenuse of said isosceles panels 5, 6 should be directed towards an inner corner 16, between the right wall 13 and left wall 14. The upper panels of all packages 1*a*, 1*b* should slope towards said inner corner 16.

Figure 3:
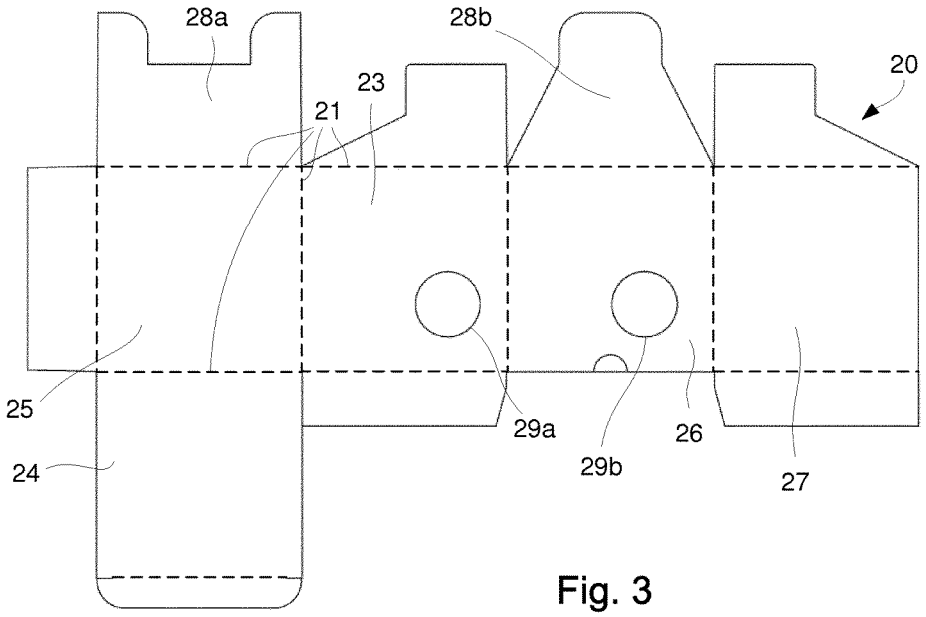
FIG. 3 shows a top view of a cardboard blank for enclosing an assembly of six packages according to the invention.
Figure 4:
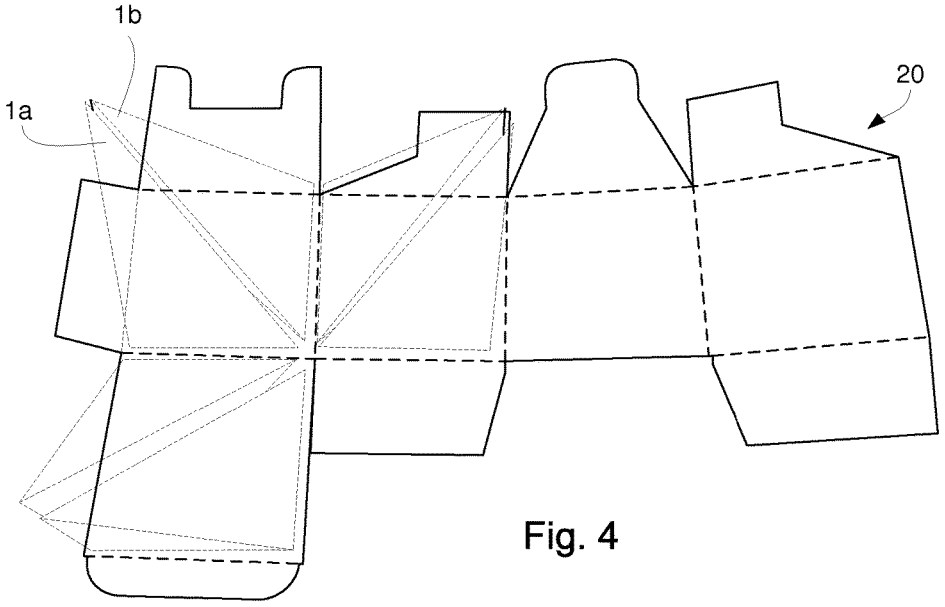
FIG. 4 shows a perspective view from the top of the cardboard blank of FIG. 3 with six packages placed on three of the walls thereof.

In FIG. 3, a more elaborate second cardboard blank 20 is shown, having many weakening lines 21 shown with dashed lines at the interior of the blank 20. This second blank 20 comprises corresponding walls to the first blank 10, namely a right wall 23, a left wall 24, a central wall 25, and additionally comprises a top wall 26 and a back wall 27. A sixth wall is created by two parts 28*a*, 28*b*, that are folded together from opposite sides. In FIG. 4, the second blank 20 is shown with packages 1*a*, 1*b* indicated in their position, before folding the blank 20 into a closed box. It is possible to attach the packages 1*a*, 1*b* to the right, left and central walls 23, 24, 25 with some form of adhesive, prior to folding the walls together. Cut-outs 29*a*, 29*b* can further be provided in some walls, e.g. for making the packages 1*a*, 1*b* visible to a consumer. The packages 1*a*, 1*b* are arranged on the right wall 23, left wall 24 and central wall 35 in the same fashion as seen in FIG. 2, and as mentioned above.

Figure 5:
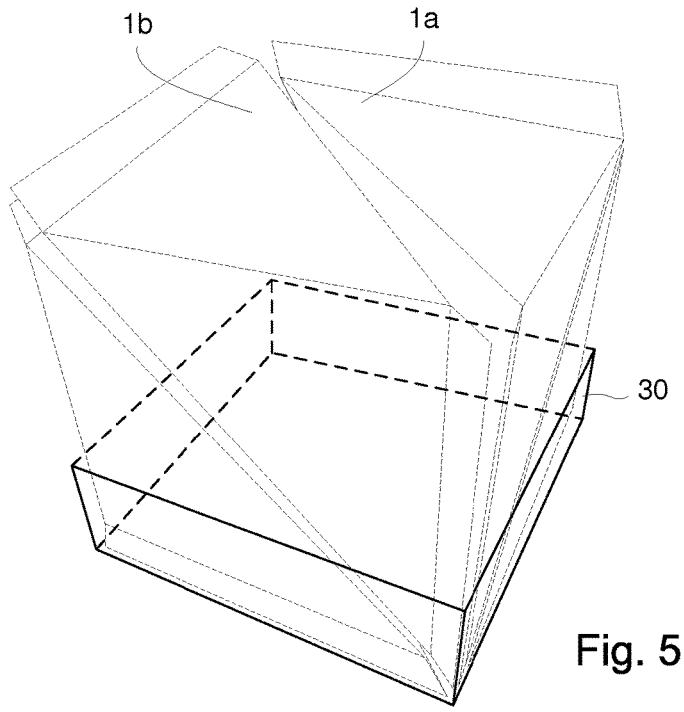
FIG. 5 shows a perspective view of an assembly of tetrahedrons held together by a low tray.

In FIG. 5, a low tray 30 is shown into which packages 1*a*, 1*b* have been arranged. This tray 30, which is folded in a way known per se, allows for the packages 1*a*, 1*b* to be placed therein in a somewhat stable state, but may require additional support for ensuring a stable assembly during transport and handling. Again, it is possible to place the packages inside the tray while also attaching the individual packages to each other, for increasing the stability of the assembly. The height of the tray 30 should be about 10-30% of the height of the assembly, or about 20% thereof.

Figure 6:
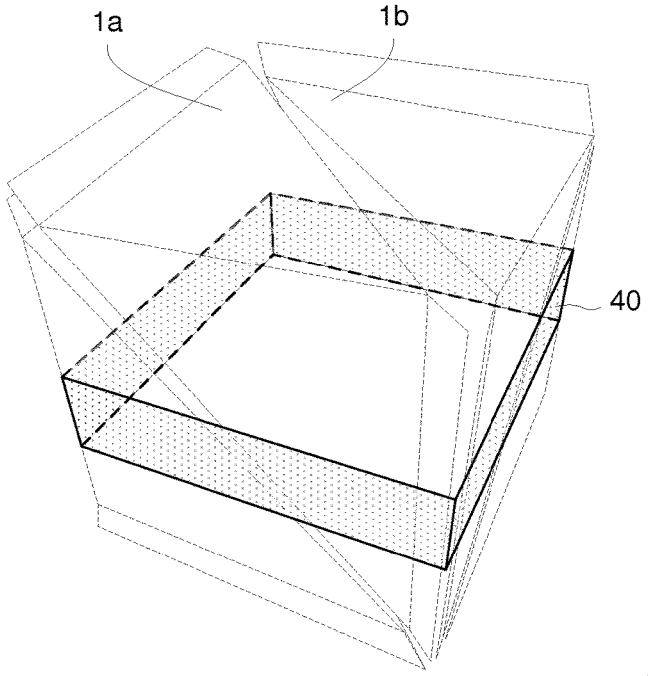
FIG. 6 shows a perspective view of an assembly of tetrahedrons held together by a looped ribbon.

In FIG. 6, a looped ribbon 40 is shown which is intended to encircle the packages 1 in their assembled state. If more rigidity of the assembly is wanted, the packages can be attached to each other with an adhesive of a known kind. The ribbon 40 can also be combined with the low tray 30, shown in FIG. 5. The width of the ribbon should be within 5-50% of the height of the assembly, or 10-30% thereof or about 20% thereof.

Figure 7:
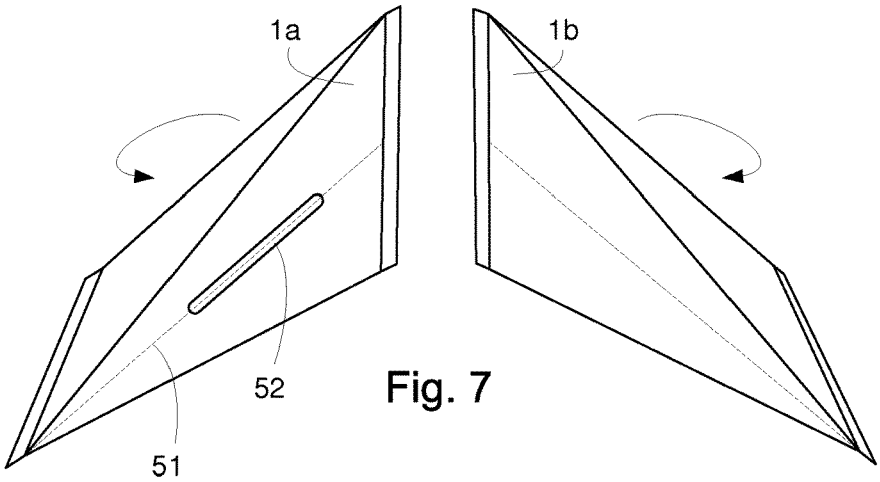
FIGS. 7 and 8 shows a side view of two tetrahedrons of different orientation according to the invention.

In FIG. 7, two packages 1*a*, 1*b* are shown, one package 1*a* of a first orientation, and a second package 1*b* with a second orientation, being mirrored in relation to the first orientation. A dashed line indicates a central line 51 along a panel of the packages 1*a*, 1*b*, which will be facing the interior of the cube when assembled. A line of adhesive 52, such as hot-melt glue or double-sided tape can be attached along at least a part of this line 51 on one of the packages 1*a*, 1*b*, and the packages are then brought together such that they attach to each other.

Figure 8:
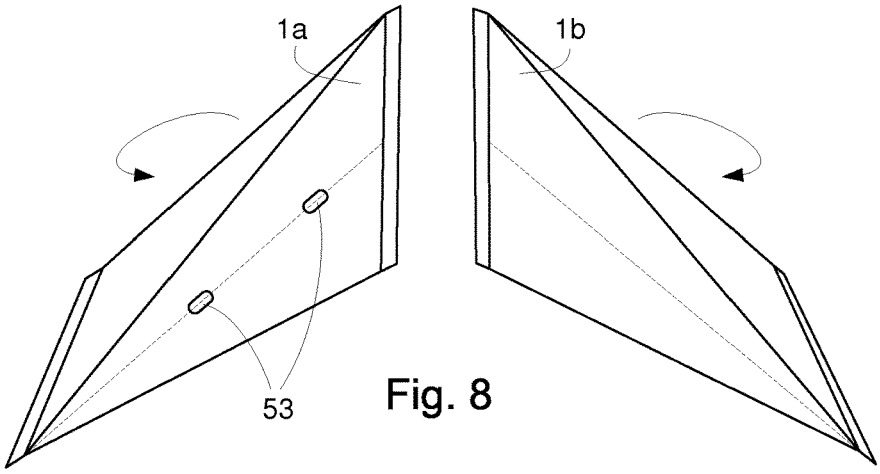

In another embodiment, as seen in FIG. 8, two separate groups of adhesive 53 are placed on the central line 51 of one package 1*a*, before the two packages 1*a*, 1*b* are brought together.

Figure 9:
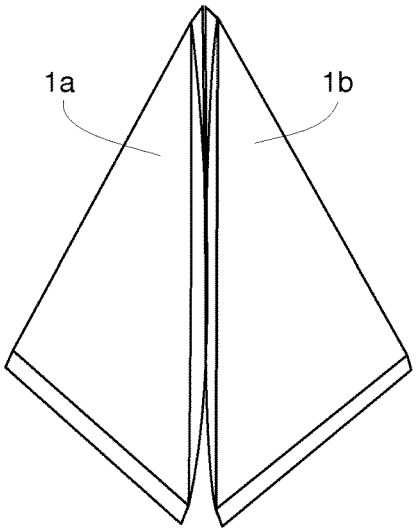
FIG. 9 shows a perspective view of the two tetrahedrons of FIGS. 7 and 8 being joined together.

In FIG. 9, two packages are seen as they are attached together, and they can be provided with adhesive 52, 53 according to FIG. 7 or 8. The linear extension of the glue as shown in FIG. 7 provides some rotational stability to the attachment, such that the packages do not rotate in relation to each other. Also the spacing of the two groups of adhesive as seen in FIG. 8 will provide this stability against unwanted relative rotation of the packages 1*a*, 1*b* in a pair. It is also possible to arrange the adhesive on a line that is offset from this central line.

Figure 10:
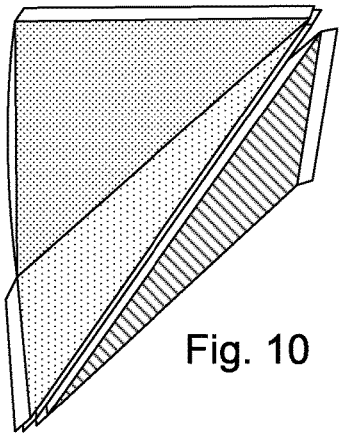
FIG. 10 shows a perspective view of three tetrahedrons according to the invention grouped together into a triangular prism.
Figure 11:
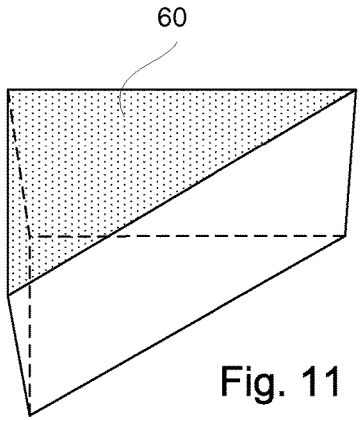
FIG. 11 shows a perspective view of an ideal triangular prism.
Figure 12:
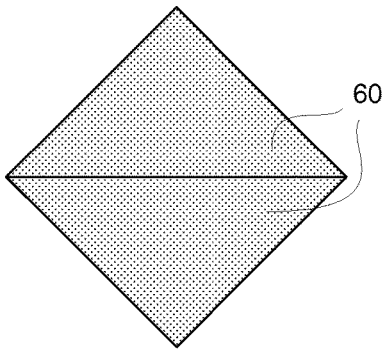
FIGS. 12-14 show top views of different ways of combining triangular prisms of FIGS. 10 and 11.
Figure 13:
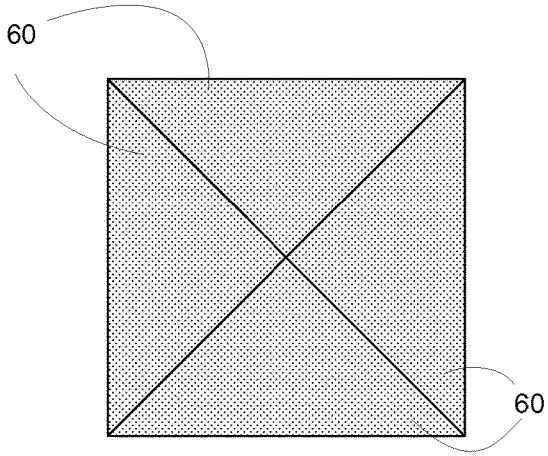
Figure 14:
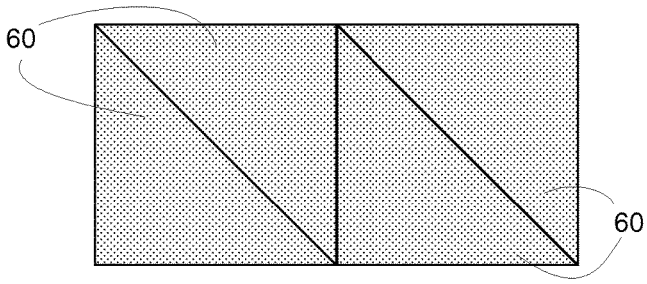

In FIG. 10, three packages 1*a*, 1*b*, 1*a* are seen grouped together into a triangular prism 60. Said prism shape 60 can be seen in idealized form in FIG. 12. This prism shape can be combined in different ways for achieving cuboid packing patterns. In FIG. 12, a known pattern is shown for arranging two triangular prisms into a cube. In FIG. 13, a different method of stacking triangular prisms is shown, creating a half-cube. This packing pattern is beneficial for small packages, since it facilitates automatic packing with e.g. robot picking equipment. In FIG. 14, another packing pattern is shown, where two cubes are placed next to each other. Also this pattern allows easier access for automatic packing equipment to enter a cardboard box from the top.

In the packing patterns that are shown in FIGS. 10 to 14, the packages 1*a*, 1*b* can either be placed loosely inside a cardboard box, or be attached together with some form of adhesive. It is also possible to attach packages 1*a*, 1*b* together prior to bringing them inside the cardboard box.

Figure 15:
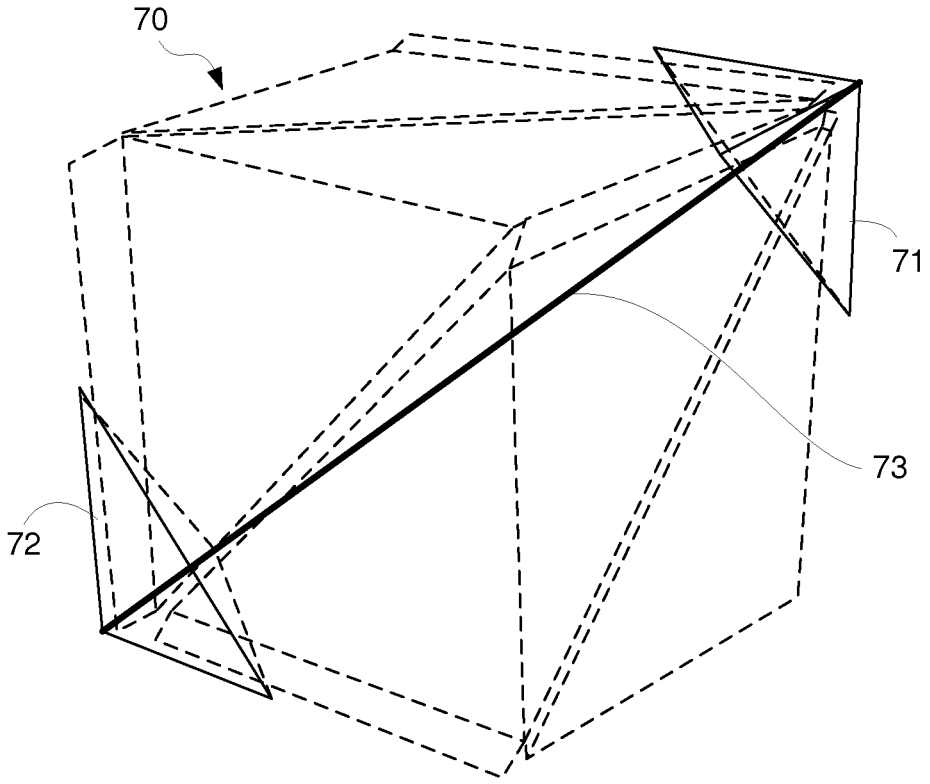
FIG. 15 shows a perspective view of a corner cap solution for grouping six packages.

Whilst the invention has been described with reference to a preferred embodiment, it will be appreciated that various modifications are possible within the scope of the invention. In FIG. 15, a further distribution solution 70 is shown. Six irregular tetrahedral packages 1*a*, 1*b* are group, in the same pattern as can be seen e.g. in FIG. 5. In this grouping, an internal diagonal is formed between the packages, spanning from opposite corners of the cube. A cap 71, 72 is placed on either opposite corner, and a bar 73 is attached to the caps 71, 72 keeping the packages together in the group. The rod 73 can be provided with hooks or ridges, and the caps 71, 72 can have matching retaining means, such that the caps are attached to the rod like a zip tie. The caps 71, 72 and the rod 73 can be made at least partly from plastic or metal, or any similar material. In one embodiment, at least one of the caps 71, 72 can be provided with a quick release for disassembling the group of packages 1*a*, 1*b*.

In this specification, unless expressly otherwise indicated, the word 'or' is used in the sense of an operator that returns a true value when either or both of the stated conditions is met, as opposed to the operator 'exclusive or' which requires that only one of the conditions is met. The word 'comprising' is used in the sense of 'including' rather than in to mean 'consisting of'. All prior teachings acknowledged above are hereby incorporated by reference. No acknowledgement of any prior published document herein should be taken to be an admission or representation that the teaching thereof was common general knowledge in Australia or elsewhere at the date hereof.

The invention claimed is:

1. Method of assembling a group of irregular tetrahedral packages having a first orientation and a mirrored second orientation, said packages each having two panels that are isosceles right triangles, and two elongated panels that are right triangles, comprising the steps of:

providing an L-shaped blank having a rectangular central wall, a rectangular right wall, and a rectangular left wall, the right wall and the left wall being attached on neighbouring edges of the central wall via weakening lines, arranging one package with a first orientation and one package with a second orientation on each of the right wall, left wall and central wall, wherein all packages are placed such that a panel with isosceles right triangle shape faces the cardboard blank, and where the hypotenuse of said panel is directed towards a central corner, between the right wall and the left wall, and such that the top downward angled edges of all packages also are directed towards said central corner, such that the cardboard blank can be folded into a cube by angling the right wall from an unfolded position, and by angling the left wall from an unfolded position, until the packages rest on top of the packages on the central wall.

2. Method according to claim 1, further comprising a step of attaching two packages together prior to being arranged on a wall.

3. Method according to claim 2, comprising a further step of attaching an adhesive on a central line of the elongated panel that is not facing away from the cardboard blank.

* * * * *